US005822809A

United States Patent [19]

Gallo

[11] Patent Number: 5,822,809

[45] Date of Patent: Oct. 20, 1998

[54] TRANSFER SEAT APPARATUS

[76] Inventor: Thomas S. Gallo, 2417 Tanglewood Dr., Sarasota, Fla. 34239

[21] Appl. No.: 920,528

[22] Filed: Aug. 29, 1997

[51] Int. Cl.[6] ..... A47K 3/022

[52] U.S. Cl. ..... 4/578.1; 4/571.1; 4/560.1; 4/562.1

[58] Field of Search ..... 4/578.1, 579, 571.1, 4/559, 560.1, 562.1, 563.1

[56] References Cited

U.S. PATENT DOCUMENTS

| | | | |
|---|---|---|---|
| 4,091,479 | 5/1978 | Hancock | 4/560.1 |
| 4,472,844 | 9/1984 | Mace . | |
| 4,475,256 | 10/1984 | Hatala . | |
| 4,941,218 | 7/1990 | McCartney . | |
| 4,951,328 | 8/1990 | Potvin . | |
| 5,068,930 | 12/1991 | Ruggiero | 4/560.1 |
| 5,097,542 | 3/1992 | Roesler . | |
| 5,150,482 | 9/1992 | Shapiro . | |
| 5,373,591 | 12/1994 | Myers . | |
| 5,390,378 | 2/1995 | Janisch . | |
| 5,517,704 | 5/1996 | Dogostino . | |
| 5,561,868 | 10/1996 | Campbell | 4/560.1 |
| 5,606,751 | 3/1997 | Baker . | |

*Primary Examiner*—David J. Walczak
*Attorney, Agent, or Firm*—Charles J. Prescott

[57] ABSTRACT

A transfer seat apparatus structured for simultaneous dependent slidable translation during manual rotation, through preferably about 90° of rotation, of a seat section of the apparatus with a person seated atop the seat section. The apparatus is particularly useful for transferring a physically impaired or weakened person into a bathtub or over a collecting basin when adapted and used as a commode. Thus, as the seat section is rotated with the person seated thereon, lateral linear translation is simultaneously effected which is dependently responsive to manual seat section rotation.

7 Claims, 4 Drawing Sheets

FIG. 8
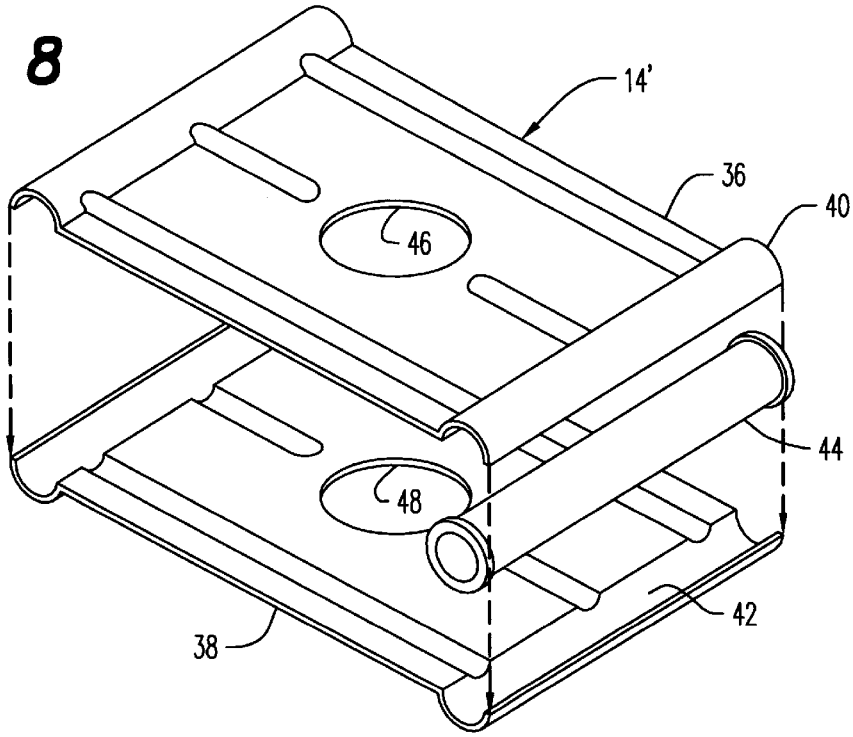
FIG. 9
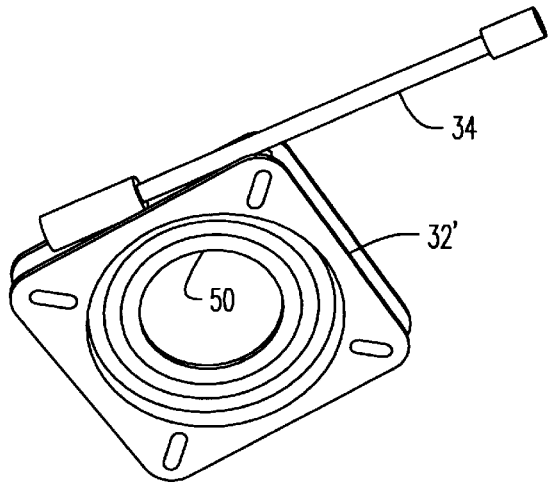
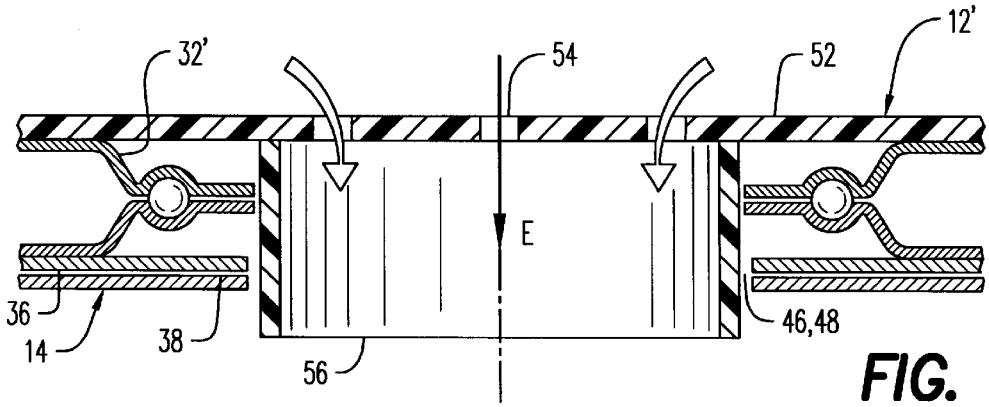
FIG. 10

TRANSFER SEAT APPARATUS

BACKGROUND OF THE INVENTION

1. Scope of Invention

This invention relates generally to seating apparatus for the physically impaired, and particularly to a transfer seat apparatus which may also be combined as a shower chair and commode.

2. Prior Art

Those who are physically challenged typically require some form of assistance from others or from various assistive devices in accomplishing daily tasks. One general form of adaptive aid equipment for the handicapped is generally in the form of a transfer seat. Such adaptive aids allow the handicapped or weakened user to take a seated position and then be manually moved a desired distance laterally such as in being positioned over a bathtub area or commode.

One such device is disclosed in U.S. Pat. No. 5,517,704 invented by Dagostino which teaches a combination commode and shower chair apparatus wherein the chair section will rollably translate on spaced parallel track members a distance sufficient to position the user over a bathtub area, the positioning of the chair being initially outside of and adjacent to the bathtub.

A tub shower seat invented by Mace is taught in U.S. Pat. No. 4,472,844 which discloses a stationary apparatus positionable over a bathtub and having an auxiliary seat surface which covers and straddles the edge of the tub for protectively supporting a handicapped user. Another similar device is disclosed in U.S. Pat. No. 4,475,256 invented by Hatala.

A somewhat more complex device than that invented by Dagostino as disclosed in the above-referenced '704 patent is shown in U.S. Pat. No. 5,373,591 invented by Myers. This invention is also directed to a shower-commode chair and transfer track used in a fashion somewhat similar to the Dagostino device.

None of the above-referenced devices, however, provide a seat swivel or pivot feature wherein the user may rotate through, e.g. 90° during the transfer or lateral translational movement of the seat section of the apparatus. In many instances, such rotational or pivotal movement is quite useful to the handicapped person in both ingress and egress and in the transfer itself. One such device which accomplishes a manual swiveling and independent translational movement is disclosed in U.S. Pat. No. 5,606,751 invented by Baker. This invention is directed to a shower chair and bathtub transfer assembly which allows the user, minimally physically impaired, to be seated atop the seat section, swivel through about 90° and then laterally translate to a position over the bathtub area.

Another such manually swivelable and independently translating or transferring apparatus is disclosed in U.S. Pat. No. 4,941,218 invented by McCartney. This invention also provides a seat structure for easy access to bathtubs and includes both structural and independent translational features of the seat section.

A number of prior art inventions are directed primarily to the swiveling or rotation of a seat section while a person is seating thereupon. One such invention is disclosed by Roesler in U.S. Pat. No. 5,097,542 teaching a bathing chair which is lockably engageable within the wall and bottom panels of a conventional bathtub and provides both manual swiveling and limited linear translation of the support chair with respect to its anchored base within the bathtub.

Potvin, in U.S. Pat. No. 4,951,328 also teaches a swivel open bottom seat assembly for pivotally moving a toilet seat support structure into operative position over the commode while the user is seated thereon.

Another device disclosed in U.S. Pat. No. 4,390,378 invented by Janisch teaches a bathtub seat arrangement which provides independent free manual rotation and lateral translation of the seat section with user thereatop with the apparatus being positioned over a bathtub. Another bathtub-related invention is shown by Shapiro as disclosed in U.S. Pat. No. 5,150,482 disclosing a bath chair having suction cup engagement for rigid engagement to the floor of a bathtub or shower stall. Independent rotation and elevation of the chair portion of this invention is provided.

The present invention provides an apparatus which dependently and controlledly laterally translates a person seated atop the seat portion of the present invention directly responsive to rotation of the seat section. By the present arrangement, lateral translation is thus dependently controlled by manual rotation of the seat portion.

BRIEF SUMMARY OF THE INVENTION

This invention is directed to a transfer seat apparatus structured for simultaneous dependent slidable translation during manual rotation, through preferably about 90° of rotation, of a seat section of the apparatus with a person seated atop the seat section. The apparatus is particularly useful for transferring a physically impaired or weakened person into a bathtub or over a collecting basin when adapted and used as a commode. Thus, as the seat section is rotated with the person seated thereon, lateral linear translation is simultaneously effected which is dependently responsive to manual seat section rotation.

It is therefore an object of this invention to provide an apparatus for assisting physically impaired or weakened persons when seated atop the invention to be rotated through approximately 90° and simultaneously dependently moved or transferred laterally into position over a bathtub, shower, commode or other useful positioning of the person.

It is still another object of this invention to provide an apparatus which dependently and automatically controls lateral translation of a person seated atop the seat section of the invention as the seat section is manually rotated.

It is still another object of this invention to provide an apparatus for typically assistedly laterally translating and simultaneously rotating a person seated atop the invention to facilitate bathing or showering, positioning over a commode and other useful lateral transfers.

In accordance with these and other objects which will become apparent hereinafter, the instant invention will now be described with reference to the accompanying drawings.

BRIEF DESCRIPTION OF THE DRAWINGS

FIG. 8 is an exploded view of the preferred embodiment of the seat base section of the invention.

FIG. 9 is a perspective view of the releasably unlockable swivel member shown in FIG. 7.

FIG. 10 is an enlarged vertical section view of a central portion of the seat section of another embodiment of the invention.

DETAILED DESCRIPTION OF THE INVENTION

Figure 1:
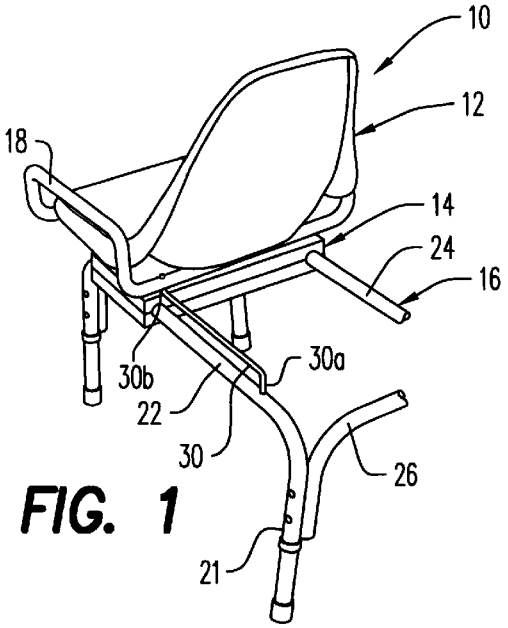
FIG. 1 is a perspective view of one embodiment of the invention.
Figure 2:
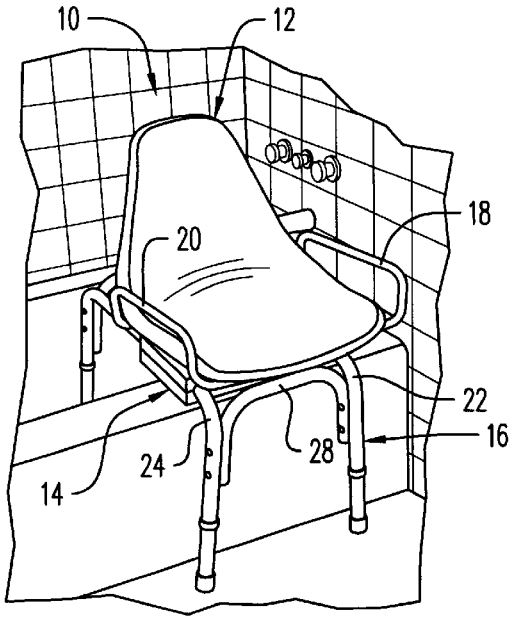
FIG. 2 is another perspective view of the invention shown in FIG. 1 in position over a bathtub.

Referring now to the drawings, and more particularly to FIGS. 1 to 6, one embodiment of the invention is generally shown at numeral 10 and generally includes a seat section or assembly 12, a seat base section 14 and a support frame assembly 16. The seat section 12 is of a conventional nature, preferably having a plastic molded seat back and bottom structure as best seen in FIG. 2. The seat base assembly 14 includes two mating base half sections 14*a* and 14*b* connected together and supporting spaced apart TEFLON or nylon elongated glide tubes 15 as seen in broken section in FIG. 6.

Figure 6:
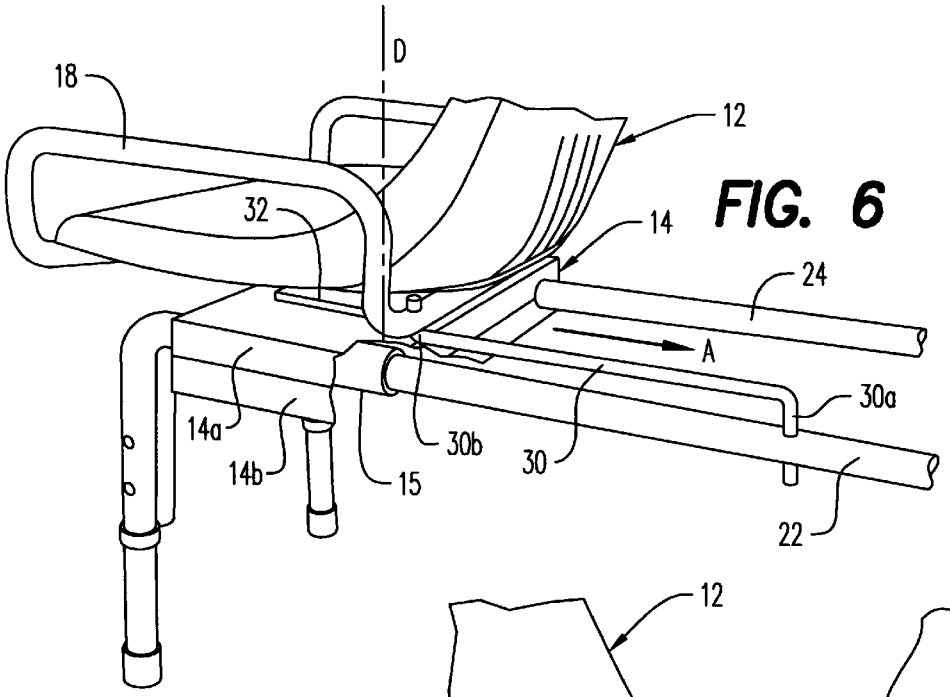
FIG. 6 is an enlarged broken perspective view of a portion of the invention shown in FIG. 1.
Figure 7:
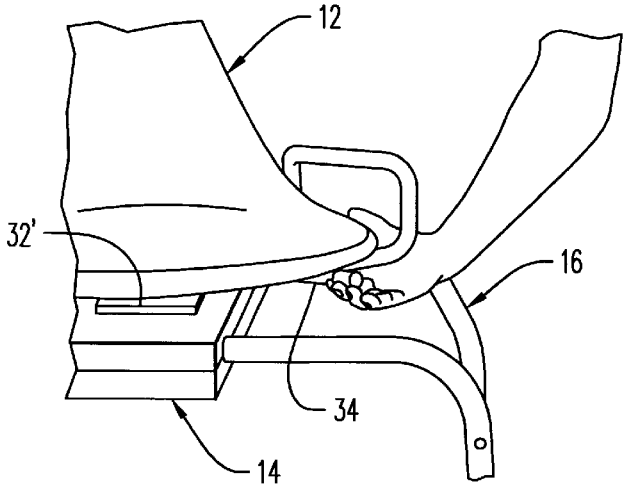
FIG. 7 is an enlarged view of a portion of another and preferred embodiment of the invention.

Positioned between the lower surface of the seat section 12 and the upper surface of the seat base section 14 is a swivel member 32 as seen in FIG. 6 or at 32' as seen in FIGS. 7 and 9. Both embodiments of the swivel member 32 and 32' are available from the Wise Company of Rector, Ark., the difference being that the preferred swivel member 32' includes a twelve way handle unlocking arrangement which is disengaged by handle 34 by the finger pulling action shown in FIG. 7. Either of the swivel members 32 or 32' (when disengaged) provide free relative rotation between the seat section 12 and the seat base section 14 about an upright axis D.

The frame section 16 is formed of tubular aluminum members formed as shown to provide two spaced apart parallel tracks or tubular rails 22 and 24 which are disposed and held by legs 21 at the upper portion of frame section 16. These tracks 22 and 24 are held spaced apart by tubular cross members 26 and 28 as seen in FIGS. 1 and 2.

The TEFLON slide tubes 15 held within the seat base section 14 are slidably engaged over each of the tubular tracks 22 and 24 as best seen in FIG. 6. Thus, the seat base section 14 with swivel member 32 or 32' attached thereatop, and with seat section 12 attached atop the swivel member 32 or 32', will freely translate laterally on tubular tracks 22 and 24 in the direction of arrow A and back.

Figure 3:
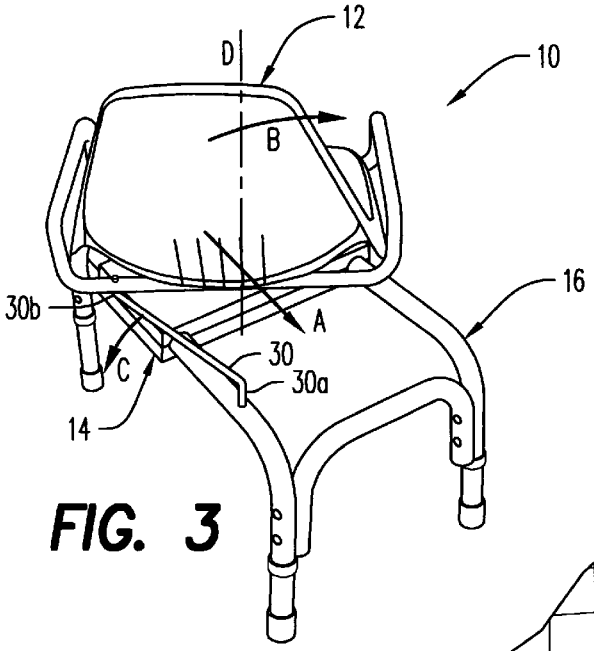
FIG. 3 is a view similar to FIG. 1 with the seat section partially rotated and laterally translated.

Thus far, as should be clear at this point, the invention 10 as thus described includes a seat section 12 which is freely pivotable about upright axis D in the direction of arrow B in FIG. 3 and is freely translatable in the direction of arrow A back and forth on tubular tracks 22 and 24. The preferred embodiment of the slide arrangement between the seat base section 14' and the tubular tracks 22 and 24 is shown in FIG. 8 and is formed of mating metal formed halves 36 and 38 which are held together by bolts (not shown). Cylindrical end portions shown at 40 and 42 secure the glide tube 44 in place. However, a conventional roller arrangement, glide members having an internal circulating ball bearing arrangement on a tubular shaft or any other freely linearly translatable structure between the seat base section 14 and the frame assembly 16 is envisioned and intended to be within the scope of this invention.

Figure 11:
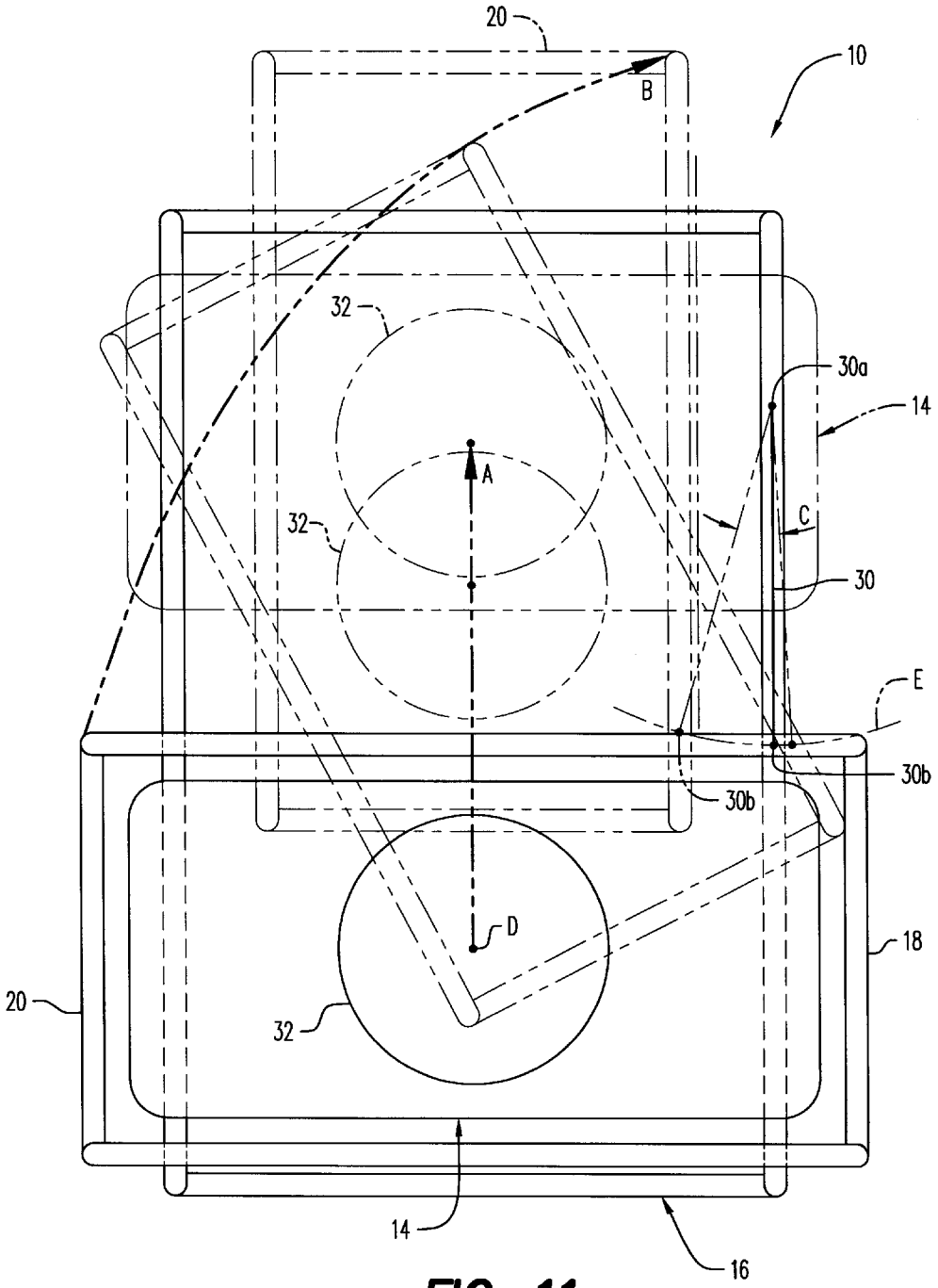
FIG. 11 is a top plan simplified schematic view of the operation of the invention.

The essential part of the invention 10 is in the form of an elongated non-extensible turning member 30 preferably formed of rigid wire or rod material having an orthogonal bend 30*a* which is pivotally connected to tubular track 22 at one end and an oppositely directed orthogonal bend 30*b* formed at the other end thereof which is pivotally connected into the tubular armrest section 18 of seat section 12. This arrangement is best understood with reference to FIG. 11 which depicts the invention at 10 in simplified schematic form, the seat section removed for clarity. The turning member 30 is shown in solid lines in conjunction with the seat base section 14 which is positioned at one end of the frame assembly 16. In this position of the seat base section 14, the seat section would be oriented with respect to the frame assembly 16 similar to that shown in FIG. 2.

Figure 5:
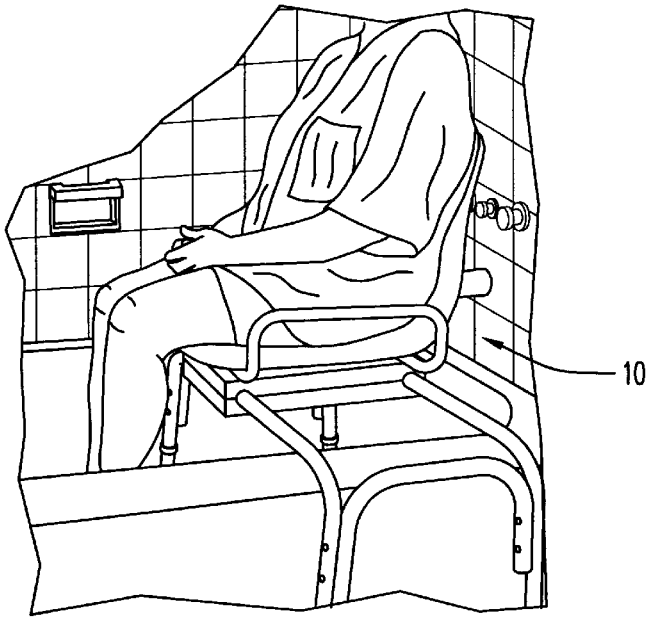
FIG. 5 is a perspective view similar to FIG. 4 showing the patent in position over the bathtub.

As the seat base assembly 14 is rotated about upright axis D, the turning member 30 pivots about connection 30*a* in the direction of arch C whereupon the other pivoted end 30*b* follows along imaginary arc E. Movement of the seat base section 14, including the tubular armrests 18 and 20 moves linearly in the direction of arrow A into a final position wherein the seat base section 14 is disposed at the opposite end of the frame assembly 16 (shown in phantom) and wherein the seat section (not shown for clarity) and armrests 18 and 20 would be rotated in the direction of arrow B in the orientation as also shown in FIG. 5 with respect to the frame assembly 16.

Thus, as the seat section 12 is rotated with the person seated thereatop, the turning member 30 requires that the seat section atop the seat base section 14 also move in the direction of arrow A along tracks 22 and 24. That is to say, rotation may not be effected without accompanying lateral movement of the seat section 12 in the direction of arrow A. It should be obvious now that pivoted end 30*b* need only be positioned and pivotally connected to the seat section 12 at a point laterally spaced from axis D.

Figure 4:
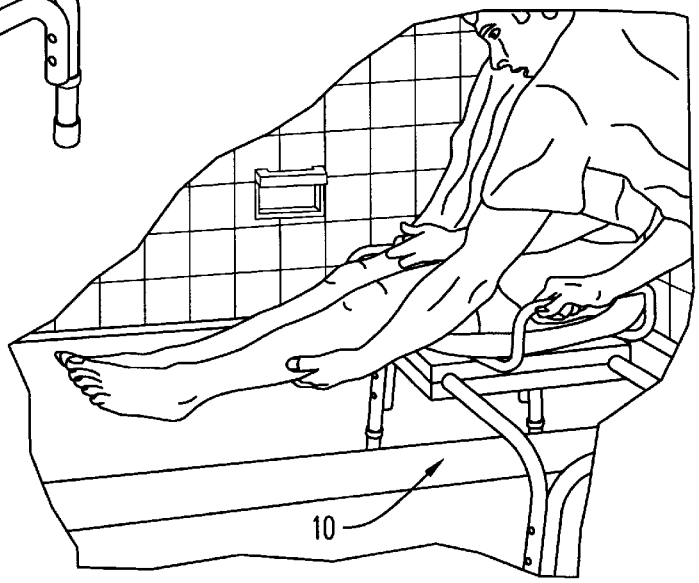
FIG. 4 is a perspective view of the invention as shown in FIG. 2 during patient transfer into a bathtub.

As seen in FIG. 4, this important feature of the invention allows an attendant to easily move a patient or disabled person while seated atop the seat section over a bathtub area without concern for uncontrolled movement of the seat section during such procedures.

Referring now to FIGS. 8, 9 and 10, a means for the downward disposal of shower water and fecal matter while a person is seated atop the invention is there shown. A plurality of drainage holes 54 are formed through the buttocks support area 52 of another embodiment of the seat section 12'. These holes 54 may be of sufficient size for fecal material to fall therethrough. Apertures 46 and 48 in halves 36 and 38, respectively, of seat base section 14' and a central aperture 50 in swivel member 32' are aligned around a cylindrical shield 56 which directs all drainage water and fecal material falling downwardly through apertures 54 in the direction of arrows E.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A transfer seat apparatus comprising:

a support frame including substantially parallel spaced apart elongated track members formed along an upper portion thereof;

a seat section adapted to supportively receive a person in a seated position thereon;

a swivel member, an upper portion of which is connected to a lower portion of said seat section whereby said seat section is rotatable on said swivel member about a central axis of rotation;

a seat base section connected at an upper portion thereof to a lower portion of said swivel member and having spaced apart slide members each connected to a respective said track member whereby said seat base is translatable along said track members; and an elongated turning member pivotally connected at one end to one said track member and pivotally connected at another end to said seat section at a point on said seat section spaced laterally from said axis of rotation whereby said seat section is controllably rotated on said swivel member by said turning member as said seat section is slidably translated on said track members.

2. A transfer and rotation seat apparatus as set forth in claim 1, further comprising:

drainage means for disposing of water which collects between the person and said seat section while showering.

3. A transfer and rotation seat apparatus as set forth in claim 1, further comprising:

means for selectively releasably unlocking said swivel member upper and lower portions for free relative rotation therebetween.

4. A transfer and rotation seat apparatus as set forth in claim 1, wherein:

said seat base section and said turning member are adapted for manual rotation of said seat member through about 90° of rotation, said seat base section being simultaneously, dependently and slidably translated from one end portion of said track members to another end portion thereof.

5. A transfer and rotation seat apparatus as set forth in claim 1, further comprising:

drainage means for disposing of water which collects between the person and said seat section while showering;

means for selectively releasably locking and unlocking said swivel member upper and lower portions for free relative rotation therebetween; and said seat base section and said turning member are adapted for manual rotation of said seat member through about 90° of rotation, said seat base section being simultaneously dependently and slidably translated from one end portion of said track members to another end portion thereof.

6. A combined transfer and rotatable seat apparatus comprising:

frame means for providing supportive ground engagement for said apparatus and having substantially straight and parallel spaced apart elongated support members;

seat means for supporting a person seated thereatop;

seat base and swivel means connected between said seat means and said support members for enabling (a) supporting said seat means, for enabling (b) free relative rotation of said seat means about an upright axis of rotation passing centrally through said seat means and for enabling (c) linear translation of said seat means on said support members; and elongated, substantially non-extensible turning means pivotally connected at each end thereof between said seat means and one said support member for dependent controlled translation of said seat means which is directly responsive to manual rotation of said seat means.

7. A combined transfer seat, shower chair and commode apparatus comprising:

frame means for providing supportive ground engagement for said apparatus and having substantially straight and parallel spaced apart elongated support members;

seat means for supporting a person seated thereatop;

seat base and swivel means connected between said seat means and said support members for enabling (a) supporting said seat means, for enabling (b) free relative rotation of said seat means about an upright axis of rotation passing centrally through said seat means and for enabling (c) linear translation of said seat means on said support members;

elongated, substantially non-extensible turning means pivotally connected at each end thereof between said seat means and one said support member for dependent controlled translation of said seat means which is directly responsive to manual rotation of said seat means; and said seat means and seat base and swivel means including substantially aligned aperture means formed centrally therethrough for downward disposal of shower water and fecal matter.

* * * * *